United States Patent [19]

Lio

[11] Patent Number: 4,616,379

[45] Date of Patent: Oct. 14, 1986

[54] CONCEALED PULL HANDLE

[76] Inventor: Kuei M. Lio, No. 6-1, Lane 291, Chung-Cheng Road, Taichung City, Taiwan

[21] Appl. No.: 661,181

[22] Filed: Oct. 15, 1984

[51] Int. Cl.[4] ..... B25G 1/04

[52] U.S. Cl. ..... 16/115; 190/117

[58] Field of Search ..... 16/115; 190/18 A, 39, 190/115, 117; 280/37, 47.17, 47.19, 47.26, 47.34

[56] References Cited

U.S. PATENT DOCUMENTS 1,202,601 10/1916 Snyder ..... 16/115 X 2,091,495 8/1937 Steen ..... 16/115 X 4,256,320 3/1981 Hager ..... 190/18 A X 4,358,006 11/1982 Castelli ..... 16/115 X

*Primary Examiner*—Fred Silverberg

*Attorney, Agent, or Firm*—Christie, Parker & Hale

[57] ABSTRACT

A handle assembly for trailing luggage which includes a tube housing a handle and two mounting members connected to the ends of the tube for mounting the tube inside the luggage. The handle is normally biassed to extend outward and is locked in its retracted position by a push button key.

1 Claim, 4 Drawing Figures

CONCEALED PULL HANDLE

BACKGROUND OF THE INVENTION

This invention relates to a handle assembly used for trailing luggage, particularly to one having a concealed handle that can be extended outwardly from the luggage by operating a push button.

Luggage with collapsible handle have been known in the arts. Recently, there has been proposed a handle assembly which includes a U-shaped handle of which two arms can be retracted into two parallel tubes provided at the bottom side of the luggage.

SUMMARY OF THE INVENTION

An object of the invention is to provide a luggage with a novel concealed handle that can be extended outward for use by simply pushing a button.

This and other objects can be achieved in accordance with the invention through the provision of a handle assembly for trailing a luggage which comprises a housing of elongated hollow shape; mounting members attached to two ends of the housing for mounting the housing inside the luggage; an elongated handle provided in the housing and normally biassed to extend outward through one of the mounting members; and means for locking the handle against the outwardly extending movement which includes a key for catching one end of the handle. The key will release the handle when it is depressed.

In one aspect of the invention, the locking means includes a body which is sleeved onto said housing and has a blind hole, and a key rod received in said blind hole and having a hook member at its bottom portion and a button at its top portion. The housing is provided with an opening in its wall adjacent to said blind hole, and the hook member is extended into the housing through the opening for catching the handle.

In another aspect of the invention, the handle includes two rods pivoted to one another and a butt provided at the rear end of one of the rods for being caught by the key.

The presently exemplary preferred embodiment will be described in detail with reference to the following drawings, wherein:

DETAILED DESCRIPTION OF A PREFERRED EMBODIMENT

Figure 1:
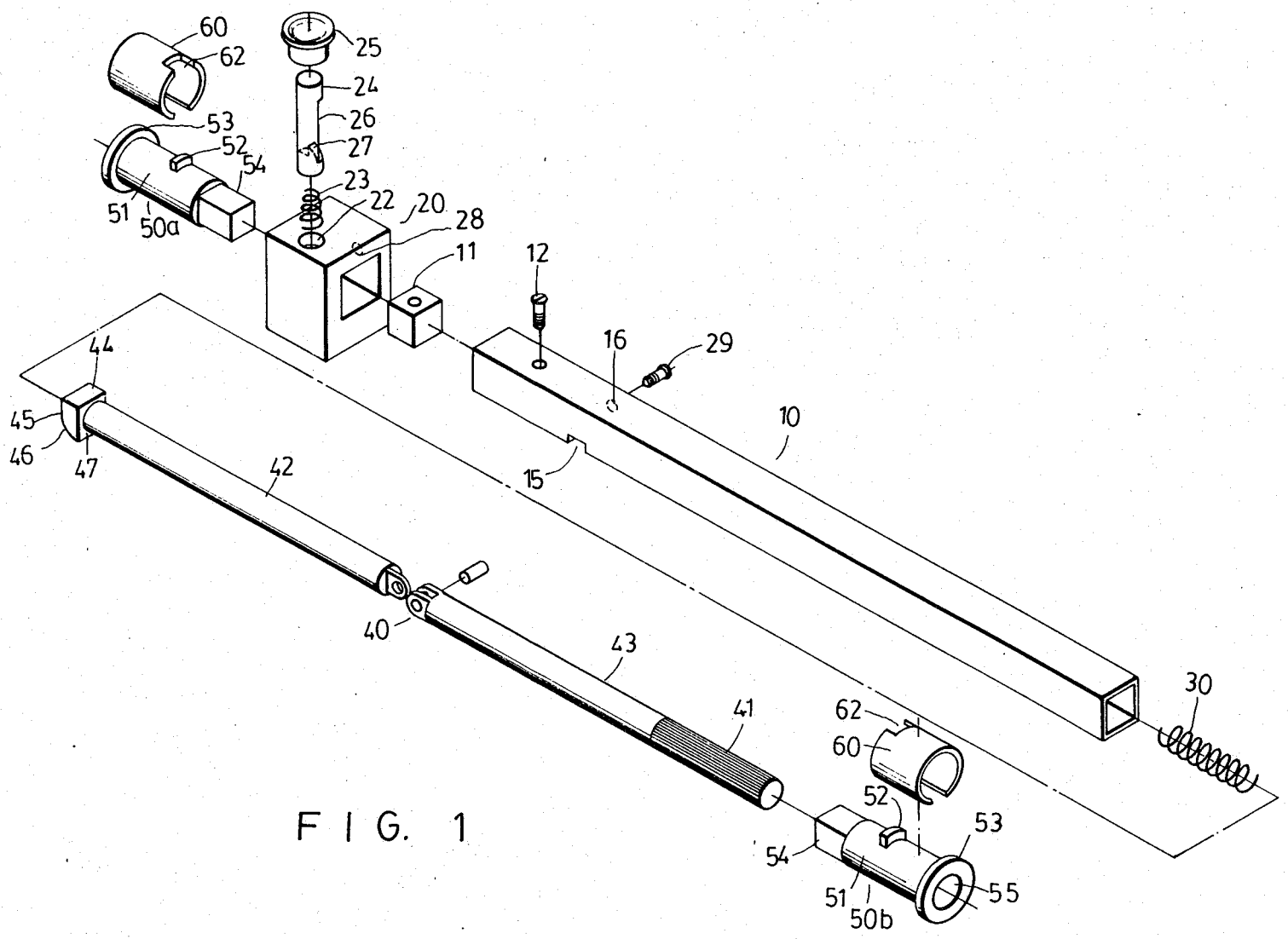
FIG. 1 is an exploded view of a handle assembly embodying the present invention.
Figure 2:
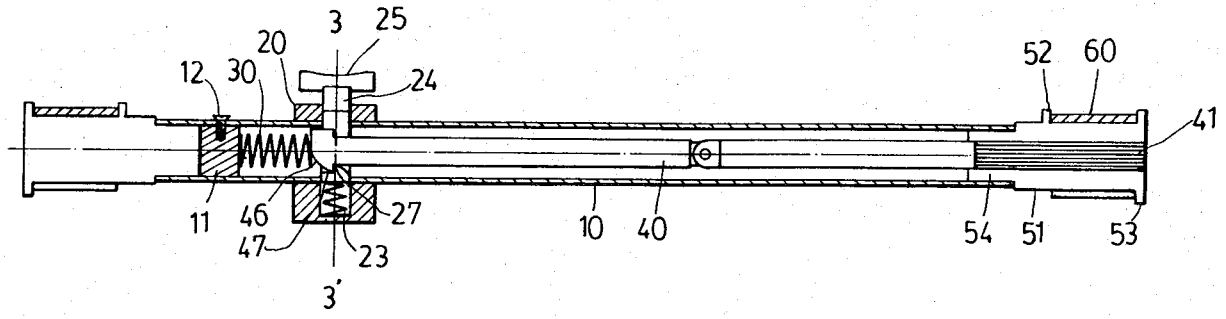
FIG. 2 is a sectioned view of the handle assembly of the same embodiment as FIG. 1.

Referring to FIGS. 1 and 2, there is shown a handle assembly which includes an tube 10 of rectangular cross-section having a block 11 positioned inside near its one end by means of a screw 12. The tube 10 is further provided with a notch 15 at its one edge near the block 11 and a hole 16 in its wall opposite to the notch 15.

Figure 3:
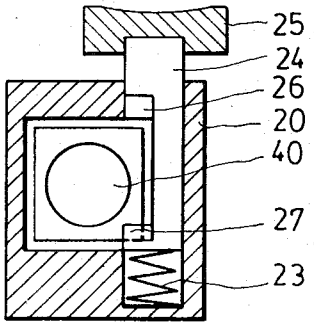
FIG. 3 is a sectioned view taken from line 3—3 of FIG. 2.

A guide member 20 of rectangular hollow shape is sleeved on the tube 10. It has a blind hole 22 receiving a spiral spring 23 and a cylindrical shaped key rod 24. The key rod 24 has a notched surface 26, a hook 27 and an outwardly extending end which is provided with a button 25. When sleeving the guide member 20 onto the tube 10, the key rod 24 is depressed so that the guide member 20 can be slid along the tube 10. The guide member 20 is fixed to the tube 10 by means of a screw 29 which penetrates into the holes 28 and 16, and the hook 27 of the key 24 extends into the interior space of the tube 10 through the notch 15 by the bias of the spring 23, as shown in FIG. 3.

Inside the tube 10 are further provided a spring 30 and a handle 40 constituted of two pivoted rods 42 and 43. The handle 40 has a rear butt 44 and a front grip end 41. The butt 44 has a surface 45 to abutt against the spring 30, a shoulder 47 to be engaged with the hook 27 when the handle 40 is retracted and an inclined surface 46 that can slidingly pass through the hook 27. The handle 40 can be released from its locked position upon depressing the key rod 24.

There are further provided two mounting members **50*a* and 50*b* for being connected to two ends of the tube 10. Both mounting members 50*a* and 50*b* include a cylindrical body 51, a protrusion 52, an annular flange 53 and a rectangular portion 54 for insertion into the end of the tube 10. However, the mounting members 50*a* and 50*b* are different in that the member 50*b* has a through-hole 55 that allows the handle 40 but prevents the butt 44** to pass therethrough.

Figure 4:
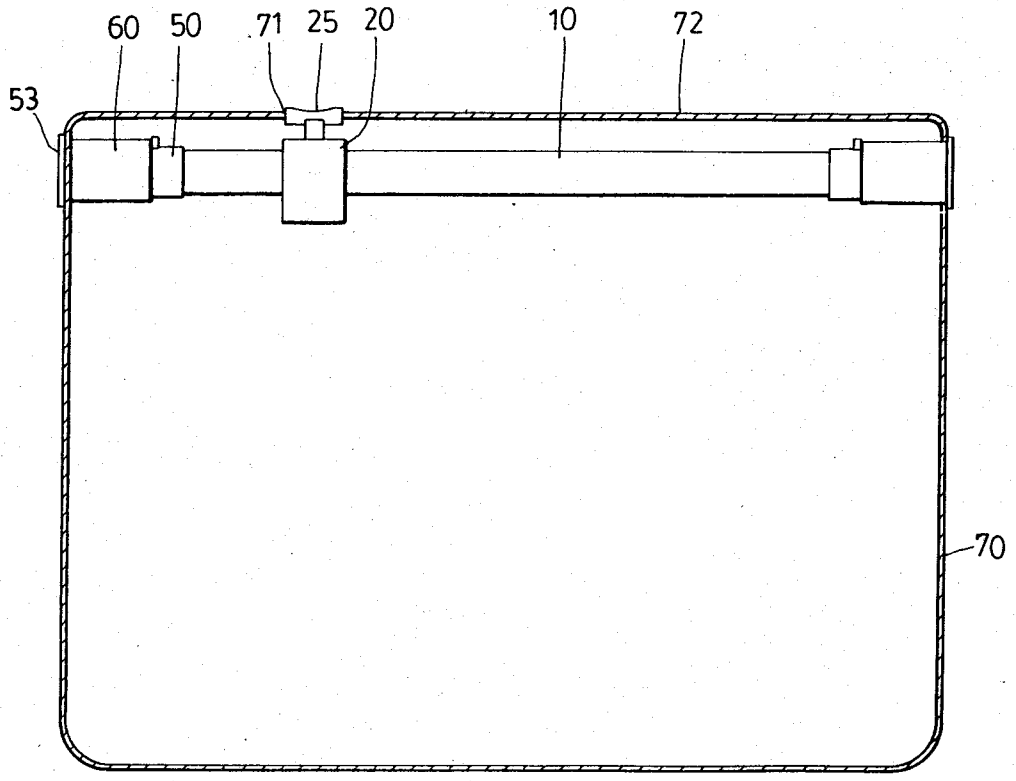
FIG. 4 is a view illustrating the incorporation of the handle assembly with the luggage.

The tube 10 is mounted inside a luggage 70 by fitting the mounting members **50*a* and 50*b* in the opposite walls of the luggage beneath the top wall 72 and then connecting the rectangular portions 54 of the mounting members 50*a* and 50*b* to the ends of the tube 10, as shown in FIG. 4. The mounting members 50*a* and 50*b* are locked against movement relative to the walls of the luggage by members 60 having a shape of a segmented annulus in its cross-section. The members 60 are sleeved onto the cylindrical bodies 51 of the mounting members 50*a* and 50*b* respectively and are provided with a notch 62 for engaging with the protrusions 52 respectively. The button 25 of the key rod 24 is exposed through an opening 71 and is flush with the top surface of the luggage 70**.

When the button 25 is depressed, the hook 27 releases the butt 44 of the handle 40 and the spring 30 biasses the handle 40 to extend out of the luggage 70. Since the handle 40 is bendable or foldable, it is convenient for the user to trail the luggage. When the handle is not used, it is retracted into the tube 10 and is locked by the key rod 24.

With the invention thus explained, it is apparent that various modifications and variations can be made without departing from the scope of the invention. It is therefore intended that the invention be limited as indicated in the appended claims.

I claim:

1. A pull handle assembly for a piece of luggage comprising: an elongated tube; mounting members attached to each end of said tube for mounting said tube inside the piece of luggage; an elongated handle, comprised of at least two rods pivoted to each other and a butt provided at a remote end of one rod of said at least two rods, located in said tube; a first spiral compression spring positioned in said elongated tube between a first end of the tube and said butt for biassing said handle to extend outward through a second end of said tube; and means for locking said handle to maintain said handle substantially within said tube, the means comprising an opening in a wall of said tube, a body, the body being sleeved onto said tube at said opening and having a blind hole which is substantially orthogonal to said tube, a one piece cylindrical shaped key rod received in said blind hole and having a hook end at a first bottom portion and a separate button head attached to a second top portion of the key rod with a hatched portion therebetween, and a second spiral compression spring positioned between the bottom of said blind hole and the bottom of the hook end for biassing said key rod to project out of said body so that said button head is accessible from outside of the piece of luggage and, said key rod extends through the opening provided in the wall of the tube with said notched portion extending at least partially around said one rod and said hook end catches said butt on the side of the butt adjacent said second spring and remote from the button head, said hook end releasing said butt when said button head is depressed allowing the handle to be extended out of said tube under the force of said first spiral compression spring.

* * * * *

UNITED STATES PATENT AND TRADEMARK OFFICE

CERTIFICATE OF CORRECTION

PATENT NO. : 4,616,379

DATED : October 14, 1986

INVENTOR(S) : Kuei M. Liu

It is certified that error appears in the above-identified patent and that said Letters Patent is hereby corrected as shown below:

Front page of patent, under heading Item [19], "Lio" should read - - "Liu" - - .

Front page of patent, under [76], change "Kuei M. Lio" to - - Kuei M. Liu - - .

Signed and Sealed this

First Day of March, 1988

*Attest:*

*Attesting Officer*

DONALD J. QUIGG

*Commissioner of Patents and Trademarks*